US006023050A

United States Patent [19]

Violi

[11] Patent Number: 6,023,050

[45] Date of Patent: Feb. 8, 2000

[54] STEAM OVEN WITH FIXED DISTRIBUTOR FOR WATER TO BE EVAPORATED

[75] Inventor: Raymond Violi, Marlens, France

[73] Assignee: Societe Cooperative de Production Bourgeois, France

[21] Appl. No.: 09/265,002

[22] Filed: Mar. 9, 1999

[30] Foreign Application Priority Data

Mar. 9, 1998 [FR] France ..... 98 03218

[51] Int. Cl.[7] ..... A21B 3/04; F22B 27/16; H47J 27/16; F24C 15/32

[52] U.S. Cl. ..... 219/401; 126/20; 239/498; 239/504

[58] Field of Search ..... 219/401; 126/20; 239/498, 504, 513, 518

[56] References Cited

U.S. PATENT DOCUMENTS 4,700,685 10/1987 Miller ..... 126/20
5,530,223 6/1996 Culzoni et al. ..... 219/401
5,619,983 4/1997 Smith ..... 126/20
5,636,622 6/1997 Amondarain et al. ..... 126/20
5,768,982 6/1998 Violi et al. ..... 126/20

*Primary Examiner*—Joseph Pelham
*Attorney, Agent, or Firm*—Ratner & Prestia

[57] ABSTRACT

In a steam oven suitable for cooking foods, for example, with a fixed distributor for the water to be evaporated, air is aspirated to form a central flow of aspirated air by a cylindrical fan and is discharged radially at the periphery toward heating elements. Water is fed into the interior of the fan by an inlet pipe and distributed in the depthwise direction of the fan by a distributor structure including a pipe end section having a lateral slot and a fixed inclined distributor plate. The invention applies to steam oven suitable for cooking foods, and assures good distribution of the water over all the heating elements so that it is evaporated.

10 Claims, 8 Drawing Sheets

FIG. 8
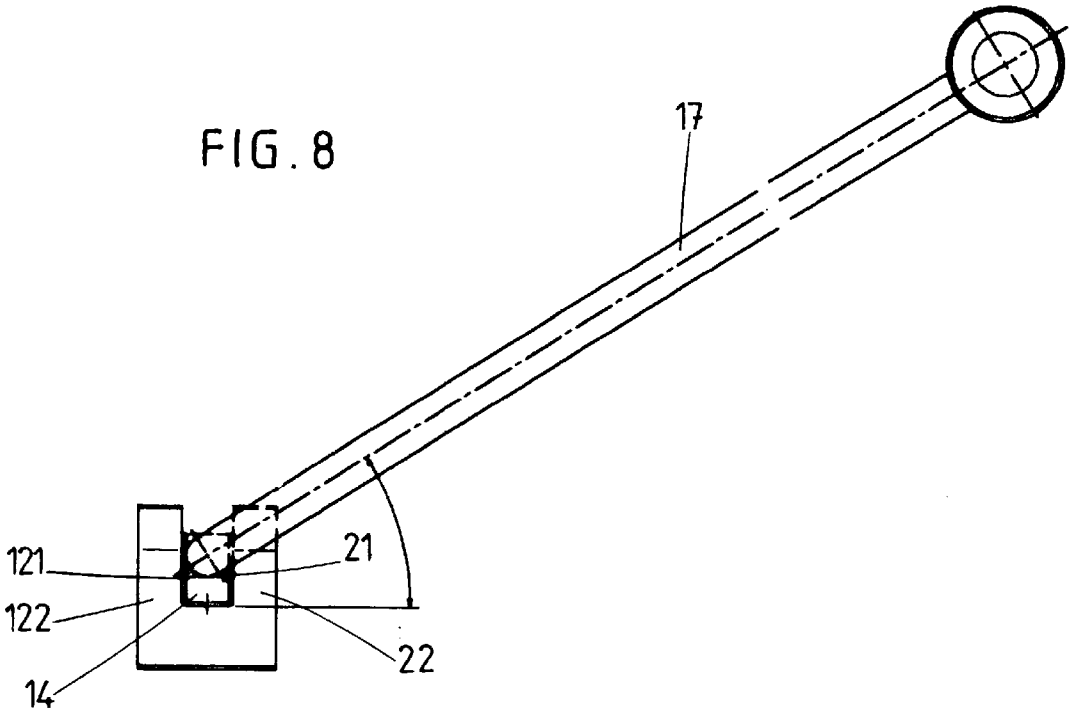
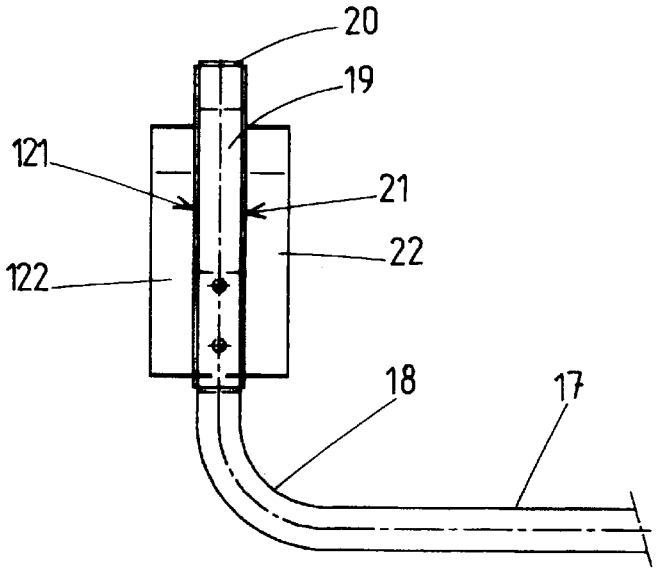
FIG. 9

STEAM OVEN WITH FIXED DISTRIBUTOR FOR WATER TO BE EVAPORATED

BACKGROUND OF THE INVENTION

1. Field of the invention

The invention concerns ovens for cooking food, comprising a cooking enclosure enclosed by a peripheral wall and a door, with an internal fan for circulating air, rotated by drive motor means, and with means for injecting water into the fan so that the fan blades project the water radially and distribute it onto heating elements disposed at the periphery of the fan.

2. Description of the prior art

Steam ovens of the above kind in which the fan contributes to spraying of the water to be evaporated have been known for a long time. In documents DE 27 47 097 A1 and DE 296 06 655 U1, for example, an internal fan for circulating air is rotated about a horizontal axis and has peripheral blades disposed in a cylinder to aspirate air axially to form an aspirated air flow and to discharge it radially in an air discharge area. Heating elements are disposed at the periphery of the fan and in its depthwise direction in the air discharge area. The water to be evaporated is fed under pressure through a water feed pipe to a spray nozzle in the central flow of aspirated air at the entry of the fan, the nozzle spraying the water axially in the direction of the aspirated air flow. With an arrangement of the above kind a greater part of the sprayed water propagates toward the back of the fan, and is equally distributed onto the corresponding heating elements around all of the periphery of the back of the fan. As a result the heating elements at the periphery of the back of the fan receive a large quantity of water, which they evaporate, whereas the heating elements at the periphery of the inlet portion of the fan receive very little water and remain at a higher temperature. Apart from an unequal distribution of the water to the heating elements, this arrangement necessitates a pressurized water feed and a spray nozzle, a nozzle of this kind tending to become blocked after a period of use because of deposits of impurities or limescale. As a result it must be cleaned fairly frequently, reliability is reduced and steam is produced in an irregular manner.

Solutions to the problem of the spray nozzle becoming blocked have been envisaged in which the water is fed through a pipe under pressure and rotary water spray means are provided in the fan to spray the water radially against the fan blades which then distribute it onto the heating elements. Document EP 0 233 535 A, for example, proposes to feed water under pressure above the fan hub. The water flows over the hub which, by virtue of its rotation, sprays it radially and projects it onto the fan blades. In document EP 0 244 538 A, an inverted cone, with its open smaller end facing the fan inlet and closed at its larger end toward the back of the fan, is fixed to the end of the fan hub. Water is fed into the cone via a pipe and is projected toward the fan blades in the form of a continuous radial film all around the periphery of the cone entry lip. In document EP 0 523 489 A, the water is fed into an open inverted rotating cone from which it escapes toward the fan blades in the form of a radial film at the posterior larger base of the cone. In document DE 41 31 748 A a perforated or ribbed disk is fixed to the end of the fan hub and water is fed onto the anterior face of the disk. Rotation of the disk sprays the water radially toward the fan blades. In document EP 0 640 310 A, water is fed onto a ribbed rotating anterior sphere which sprays the water radially toward the fan blades.

In all these arrangements with rotary water spray means, the water is regularly distributed around the periphery but the water is distributed unevenly along the depth of the fan. As a result only some portions of the heating elements receive a significant quantity of water to be evaporated, other heating element portions receiving only a small portion of the water to be evaporated or none at all. Also, providing the rotating spray parts makes it necessary to modify the structure of the fan and to balance the rotating parts. Manufacture is therefore more complicated.

The problem addressed by the present invention is that of designing a new structure for spraying and distributing water in a steam oven fan that assures an even distribution of the water at the periphery of the fan and in the depthwise direction of the fan, without affecting the balance of the fan itself, and is compatible with a water feed that is not pressurized and therefore without a spray nozzle.

Another object of the invention is to facilitate cleaning of the functional parts of the oven, and in particular the water spraying and distribution parts.

SUMMARY OF THE INVENTION

To achieve the above objects, and others, an oven for cooking food according to the invention comprises a cooking enclosure closed by a peripheral wall and a door, an internal fan for circulating air and rotated by drive motor means about a horizontal axis and having peripheral blades disposed in a cylinder to aspirate air axially to form a central flow of aspirated air and to discharge it radially in an air discharge area, heating elements distributed at the periphery of the fan and in its depthwise direction in the air discharge area, at least one inlet pipe for conveying water that is not pressurized from an external water supply to a pipe outlet in the central flow of aspirated air, and means for distributing water from the pipe outlet toward the blades of the fan; the water distributing means comprise:

- a pipe end section oriented in a direction substantially parallel to the horizontal axis of the fan and fed with a flow of water in a direction opposite to the central flow of aspirated air,
- at least one longitudinal slot on one side of the pipe end section enabling water to escape laterally,
- at least one fixed distributor plate disposed and oriented so that water from the longitudinal slot flows and is distributed by the central flow of aspirated air in an area extending in the depthwise direction of the fan.

In one advantageous embodiment, the pipe end section is offset laterally away from the horizontal axis of the fan, and a distributor plate and the associated longitudinal slot are disposed at the end of the pipe end section nearer the blades of the fan.

In accordance with one possibility, the pipe end section comprises two opposite longitudinal slots, disposed on respective opposite lateral sides and each associated with a respective fixed distributor plate.

The distributor plate is preferably inclined with an ascending orientation following the direction of the central flow of aspirated air.

In one preferred embodiment, the distributor plate is elongate in the direction of the central flow of aspirated air, and the distributor plate is extended beyond the corresponding lateral slot toward the interior of the fan.

Good distribution results are obtained if the distributor plate has a front section inclined with a first inclination followed by a rear section inclined with a second inclination greater than the first inclination.

In all cases, the distributor plate is positioned in the fan so that its front end is substantially level with the front end of the corresponding lateral slot and level with the anterior end plate of the heating elements and so that its rear end is slightly in front of the rear end plane of the heating elements.

Other objects, features and advantages of the present invention will emerge from the following description of particular embodiments, given with reference to the accompanying drawings.

BRIEF DESCRIPTION OF THE DRAWINGS

FIG. 8 is a front view of the water distributing means of the FIG. 7 embodiment.

FIG. 9 is a plan view of the water distributing means from FIG. 8.

DETAILED DESCRIPTION OF THE PREFERRED EMBODIMENTS

Figure 1:
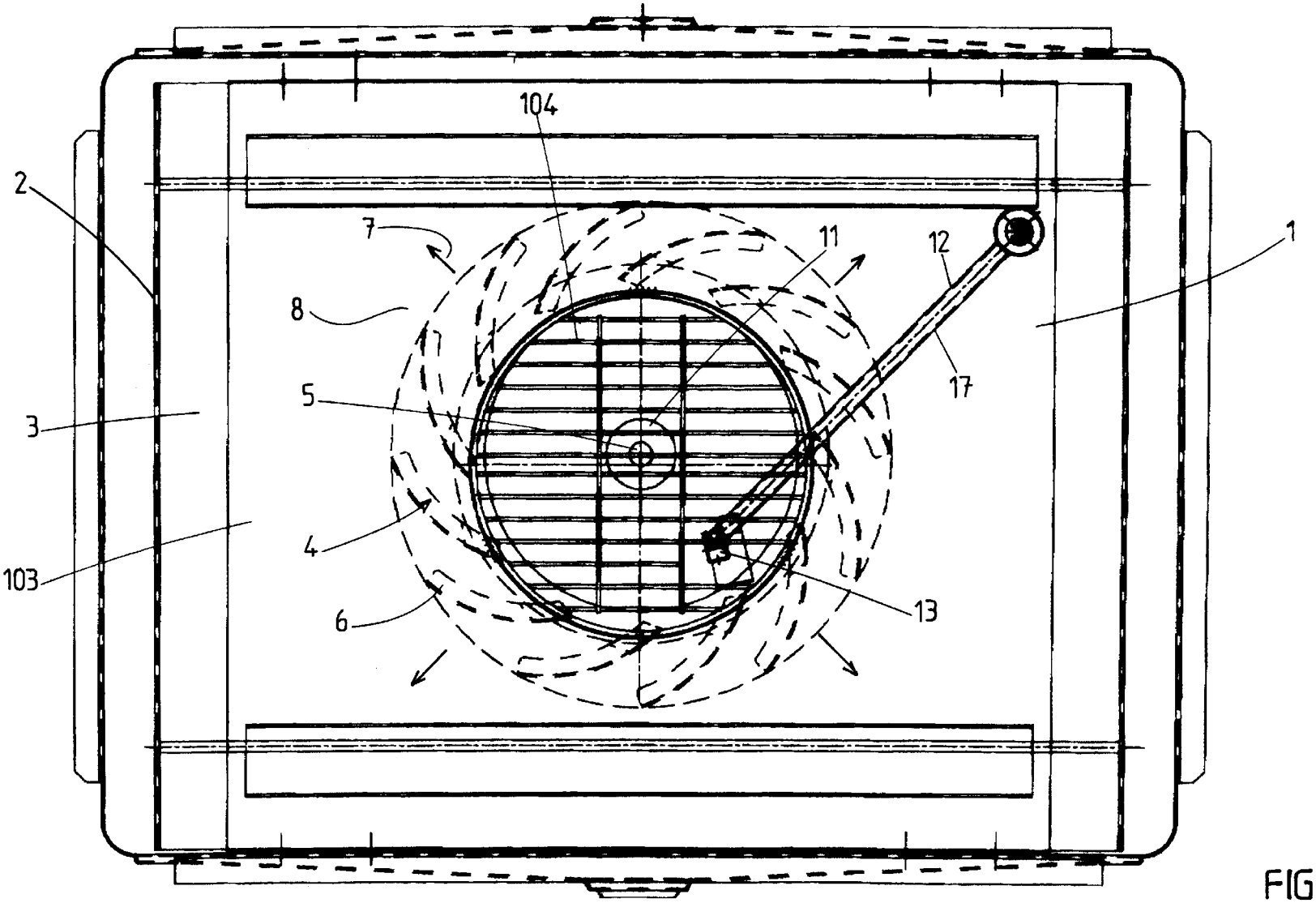
FIG. 1 is a front view of the main parts of one embodiment of a steam oven in accordance with the present invention.

In the embodiment shown in FIG. 1, the oven in accordance with the invention comprises a cooking enclosure 1 delimited by a peripheral wall 2, with a closed back 3, and an open front opposite the back 3 and closed by a door, not shown.

A fan 4 for circulating air, disposed inside the cooking enclosure 1, is rotated by drive motor means, not shown, rotating about a horizontal axis 5 on a front-to-rear horizontal shaft passing through the back 3. The fan 4 has peripheral blades such as the blade 6 disposed in a cylinder around the horizontal axis 5 to aspirate air axially to form a central flow 16 of aspirated air (FIG. 6) and to discharge the air radially as shown by the arrow 7 in an air discharge area 8 at the periphery of the fan 4.

Figure 2:
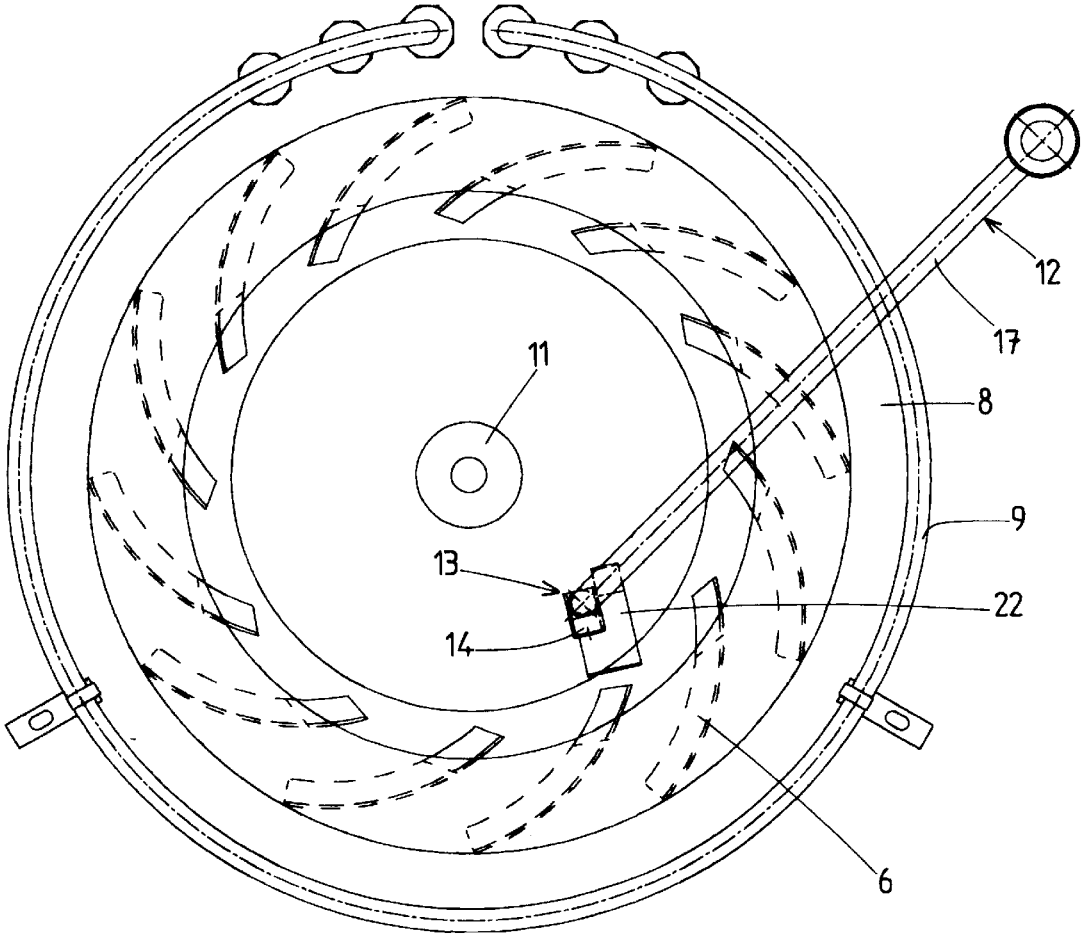
FIG. 2 is a front view of the steam generating parts of the oven from FIG. 1 which simultaneously circulate air, apply heat and produce steam.
Figure 3:
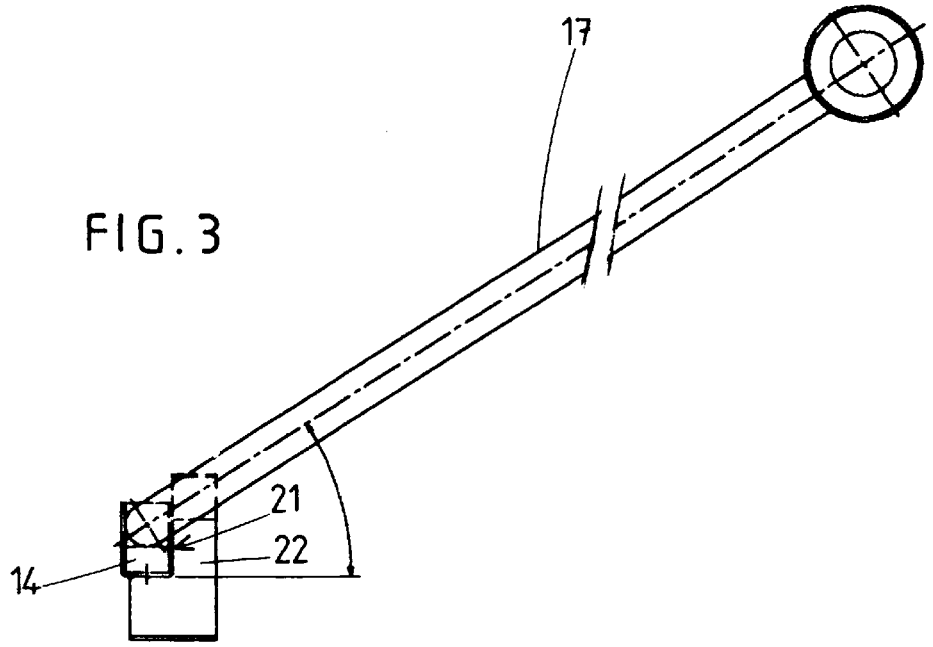
FIG. 3 is a front view of the water distributing means from the embodiment shown in FIGS. 1 and 2.
Figure 4:
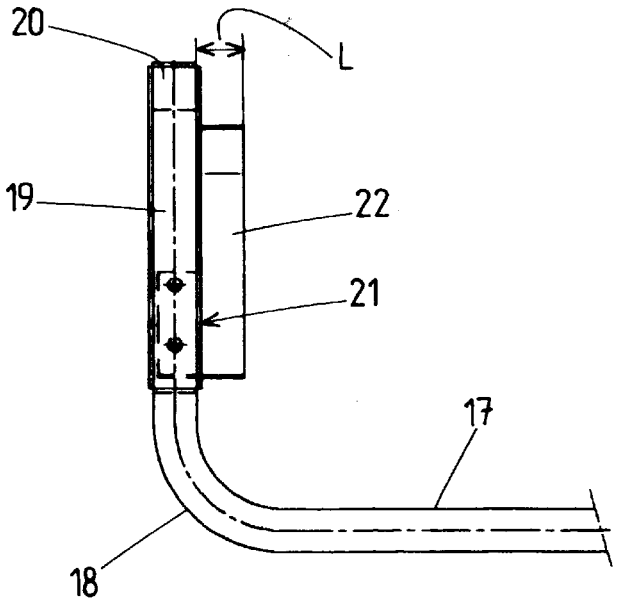
FIG. 4 is a plan view of the water distributing means from FIG. 3.
Figure 5:
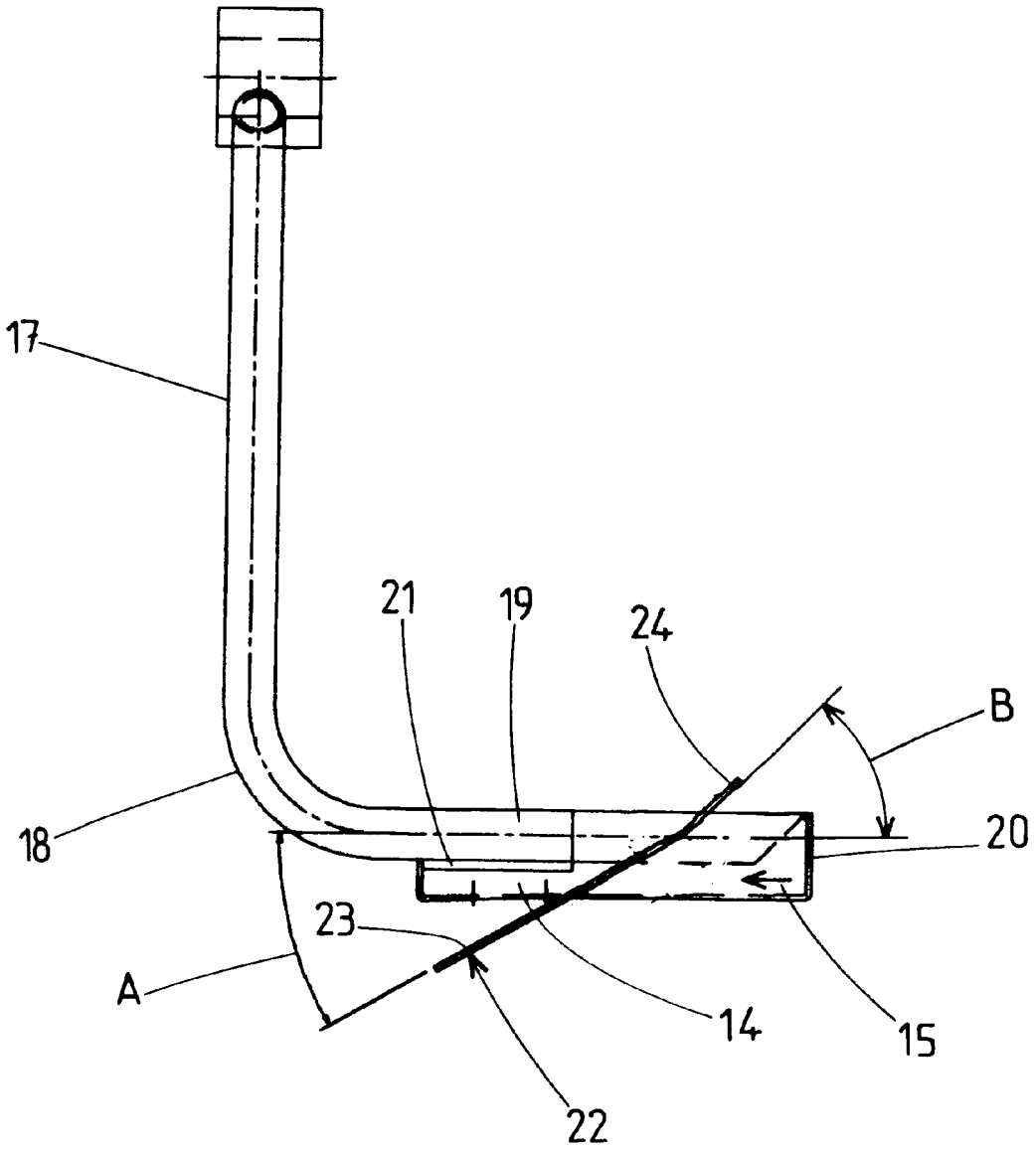
FIG. 5 is a righthand side view of the water distributing means from FIG. 3.
Figure 6:
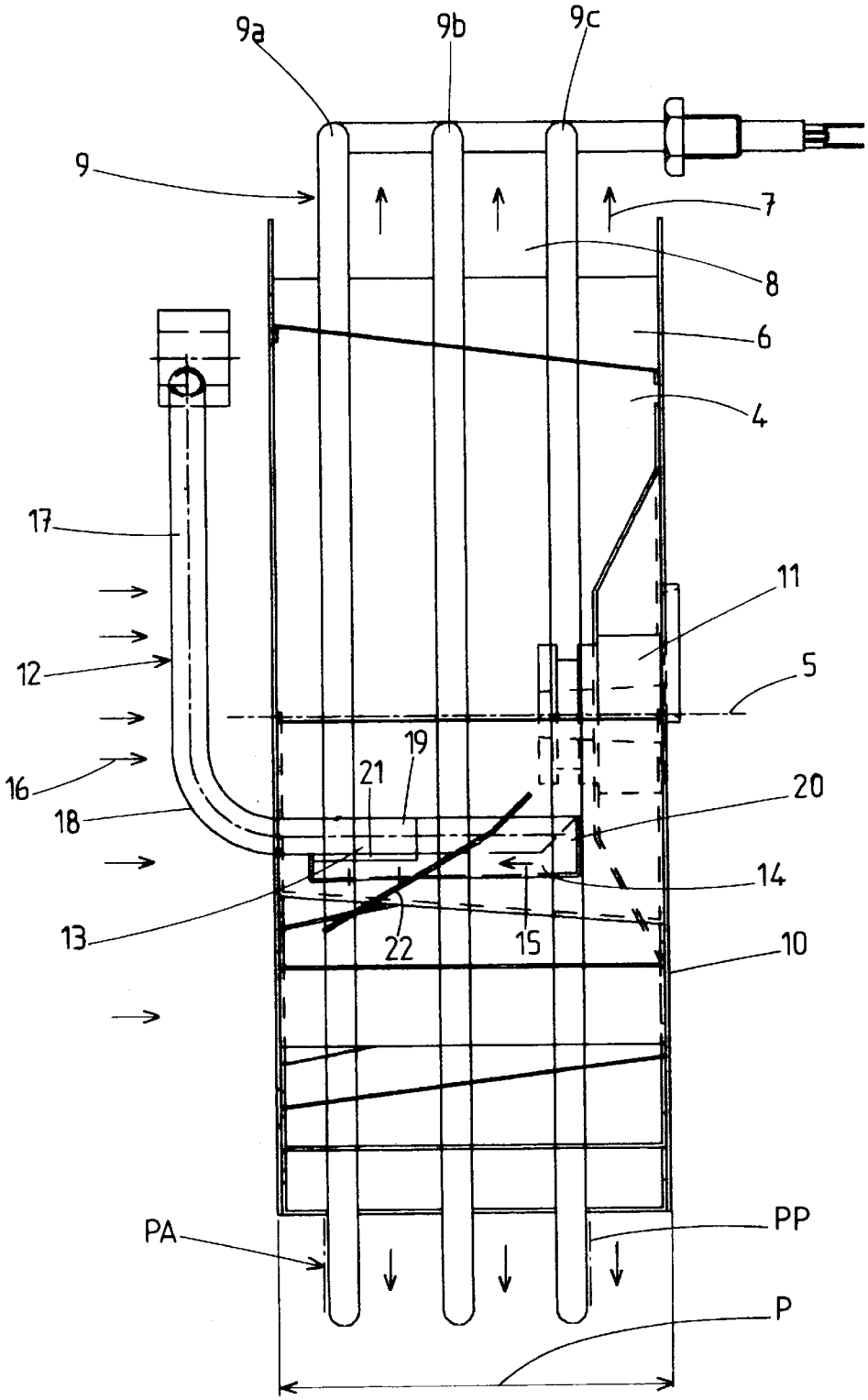
FIG. 6 is a righthand side view of all the steam generating parts of the oven from FIG. 2.

As shown in more detail in FIGS. 2 and 6, heating elements 9 are disposed in the air discharge area 8 at the periphery of the fan 4 and in its depthwise direction.

In a manner that is known per se, the fan 4 has a rear flange 10 attached to the hub 11 and the blades 6 form a structure closed toward the rear by the rear flange 10 and open at the front.

A downward entry pipe 12 is adapted to convey water without being pressurized from an external water supply, not shown, to a pipe outlet 13 placed in the central flow 16 of aspirated air. The pipe outlet 13 does not have a spray nozzle with a small diameter orifice.

Fixed means distribute water from the pipe outlet 13 and toward the blades 6 of the fan 4 in a distributed manner around the periphery and in the depthwise direction of the fan 4.

As shown in FIG. 6, for example, the heating elements 9 comprise three circular heating elements 9*a*, 9*b* and 9*c* disposed at three separate places regularly distributed in the depthwise direction P of the fan 4. The water distributing means in accordance with the invention spray water evenly between the three heating elements 9*a*, 9*b* and 9*c* of the set 9 of heating elements.

In the embodiment shown in more detail in FIGS. 1 to 6, the means for distributing water from the pipe outlet 13 toward the blades 6 of the fan 4 include a pipe end section 14, oriented in a direction substantially parallel to the horizontal axis 5 of the fan 4, and fed with water according to a flow of water in a direction 15 opposite to the central flow 16 of aspirated air, as shown in FIG. 6 in particular. To this end, the entry pipe 12 has an oblique first section 17, in front of the fan 4, joined by a front elbow 18 to an axial section 19 generally parallel to the horizontal axis 5 of the fan 4 and extending rearward into the interior space of the fan as far as a rear elbow 20 connected itself to the end section 14. The end section 14 can be below the axial section 19, as shown in the figures.

At least one longitudinal slot 21 is provided on one side of the pipe end section 14, to allow water to exit laterally.

A fixed distributor plate 22 is disposed and oriented relative to the longitudinal slot 21 so that water from the longitudinal slot flows and is distributed over the distributed plate 22 by the central flow 16 of aspirated air in an area extending in the depthwise direction P of the fan 4.

The distributor plate 22 is preferably inclined with an upward orientation in the direction of the central flow 16 of aspirated air, as shown in the figures and in FIG. 6 in particular. The distributor plate is advantageously a plate that is elongate in the direction of the central flow 16 of aspirated air, it occupies the length of the corresponding lateral slot 21 and extends beyond the lateral slot 21 toward the interior of the fan 4.

In the embodiment shown in the figures, the distributor plate 22 has a front section 23 inclined at a first angle A, for example approximately 30° to the horizontal, followed by a rear section 24 inclined to the horizontal at a second angle B greater than the first angle A, for example approximately 45°.

The front section 23 can occupy substantially three-quarters of the length of the distributor plate 22, the rear section 24 occupying the rear quarter of the length of the distributor plate 22.

In the embodiment shown in the figures, the lateral slot 21 occupies substantially half the front length of the distributor plate 22.

To assure good distribution over all of the depth of the fan 4, the distributor plate 22 is positioned in the fan 4 so that its front end is substantially level with the front end of the corresponding lateral slot 21 and level with the front end plane PA of the heating elements 9, and its rear end is slightly in front of the rear end plane PP of the heating elements 9, as shown in FIG. 6.

The width L by which the distributor plate 22 projects laterally beyond the corresponding lateral slot 21 can advantageously be in the range approximately 5 mm to approximately 15 mm, and substantially constant.

In the embodiment shown in FIGS. 1 and 2, the distributor plate 22 is placed laterally on one side only of the pipe end section 14, and is associated with a single lateral slot 21. The pipe end section 14 is then preferably offset laterally away from the horizontal axis 5 of the fan 4, and below that axis 5. For example, if the end section 14 is to the right of the horizontal axis 5 of the fan 4 the distributor plate 22 is also to the right of the end section 14, nearer the blades 6 of the fan 4. Accordingly, the distributor plate 22 and the associated longitudinal slot 21 are disposed on the side of the pipe end section 14 nearer the blades 6 of the fan 4.

In the embodiment shown in FIGS. 7 to 10, the pipe end section 14 has two opposed longitudinal slots, respectively 21 and 121, disposed on respective opposite lateral sides of the axis of the end section 14 and each associated with a fixed distributor plate 22 or 122. The distributor plate 122 has the same structure as the distributor plate 22 previously described.

Figure 7:
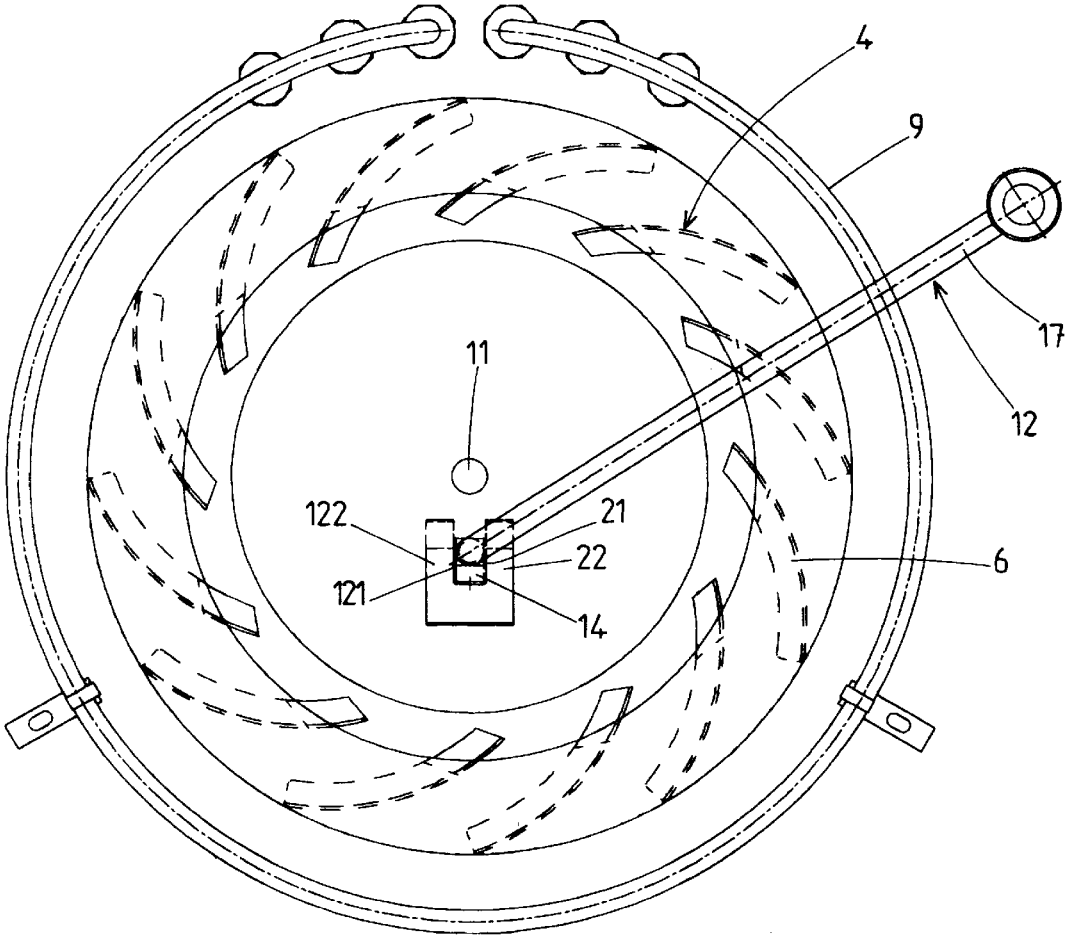
FIG. 7 is a front view showing a different embodiment of the steam generating parts of the oven.
Figure 10:
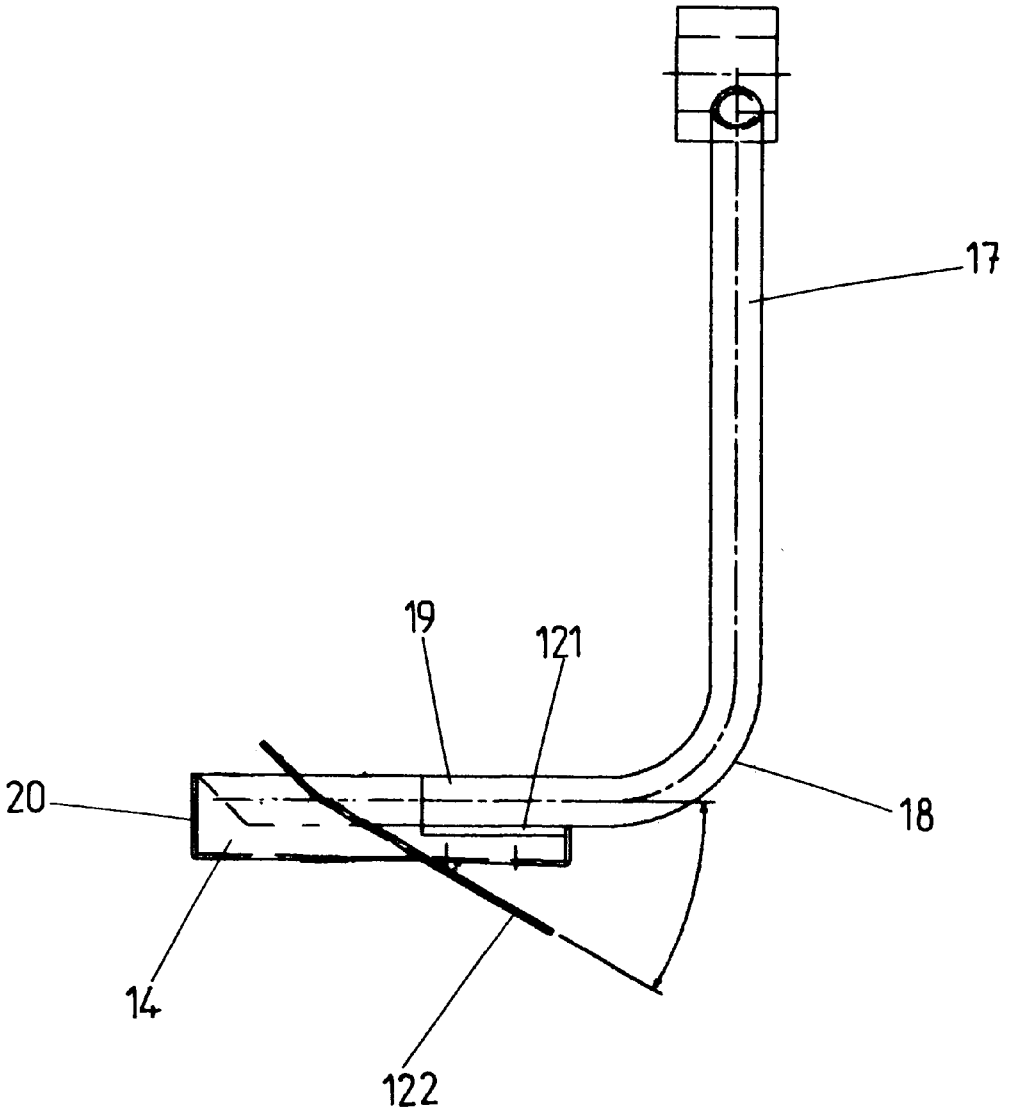
FIG. 10 is a lefthand side view of the water distributing means from FIG. 8.

In this case, as shown in FIG. 7, the distributor structure with the plates 22 and 122, the pipe end portion 14 and the slots 21 and 121 could be placed under the hub 11 of the fan 4.

The device in accordance with the invention operates as follows: when the fan 4 rotates in the appropriate direction, air is aspirated by the fan 4 to form a central flow 16 of aspirated air, shown in FIG. 6, and the air is discharged radially at the periphery of the fan to form a radial flow 7 in the air discharge area 8 and across the heating elements 9. Water flows without being pressurized into the entry pipe 12, arriving via the oblique section 17, the front elbow 18, the axial section 19, and its flow direction is then reversed by the rear elbow 20 so that it travels from the rear toward the front in the direction of flow 15 inside the pipe end section 14. The water then escapes via the lateral slot 21 and flows onto the inclined distributor plate 22. The central flow 16 of aspirated air then distributes the water over the distributor plates 22, and droplets of water escape from the edges of the distributor plate 22 and are conveyed by the flow of air onto the blades 6 of the fan 4, which sprays them again onto the heating elements 9, which evaporate them. The distribution structure in accordance with the invention assures good distribution of droplets of water between the heating elements, all around the periphery of the fan 4 and throughout the depth P of the fan 4.

The pipe end structure, and possibly even the whole of the entry pipe 12, can advantageously be removable for periodic cleaning.

As shown in FIG. 1, the fan 4 can be disposed behind an intermediate wall 103 with a central opening through which the air enters the fan. A protective grid 104 is placed in the central opening in the intermediate wall 103 to prevent penetration of foreign bodies into the fan 4 but to allow air to pass.

Alternatively, a plurality of water inlet pipes could be provided, each having a separate pipe outlet, the pipe outlets being disposed around the horizontal axis 5.

The present invention is not limited to the embodiments that have been explicitly described, but encompasses variants and generalizations thereof within the scope of the following claims.

There is claimed:

1. An oven for cooking food comprising a cooking enclosure closed by a peripheral wall and a door, an internal fan for circulating air and rotated by drive motor means about a horizontal axis and having peripheral blades disposed in a cylinder to aspirate air axially to form a central flow of aspirated air and to discharge it radially in an air discharge area, heating elements distributed at the periphery of said fan and in its depthwise direction in said air discharge area, at least one inlet pipe for conveying water that is not pressurized from an external water supply to a pipe outlet placed in said central flow of aspirated air, and means for distributing water from said pipe outlet toward said blades of said fan, wherein said water distributing means comprise:

a pipe end section oriented in a direction substantially parallel to the horizontal axis of said fan and fed with water according to a flow of water in a direction opposite to said central flow of aspirated air, at least one longitudinal slot on one side of said pipe end section enabling water to escape laterally, and at least one fixed distributor plate disposed and oriented so that water from said longitudinal slot flows and is distributed by said central flow of aspirated air in an area extending in the depthwise direction of said fan.

2. The oven claimed in claim 1 wherein said pipe end section is offset laterally away from said horizontal axis of said fan and a distributor plate and the associated longitudinal slot are disposed at the end of said pipe end section nearer said blades of said fan.

3. The oven claimed in claim 1 wherein said pipe end section comprises two opposite longitudinal slots disposed on respective opposite lateral sides and each associated with a respective fixed distributor plate.

4. The oven claimed in claim 1 wherein said distributor plate is inclined with an ascending orientation and in the direction of said central flow of aspirated air.

5. The oven claimed in claim 4 wherein said distributor plate is elongate in the direction of said central flow of aspirated air and the distributor plate is extended beyond the corresponding lateral slot toward the interior of said fan.

6. The oven claimed in claim 4 wherein said distributor plate has a front section inclined with a first inclination followed by a rear section inclined with a second inclination greater than said first inclination.

7. The oven claimed in claim 6 wherein said first inclination is approximately 30° to the horizontal and said second inclination is approximately 45° to the horizontal.

8. The oven claimed in claim 1 wherein said distributor plate is positioned in said fan so that its front end is substantially level with the front end of the corresponding lateral slot and level with the front end plane of said heating elements, and its rear end is slightly in front of the rear end plane of said heating elements.

9. The oven claimed in claim 8 wherein said lateral slot occupies substantially half the front length of said distributor plate.

10. The oven claimed in claim 1 wherein the width by which said distributor plate projects laterally beyond the corresponding lateral slot is in the range approximately 5 mm to approximately 15 mm, and substantially constant.

* * * * *

UNITED STATES PATENT AND TRADE MARK OFFICE

CERTIFICATE OF CORRECTION

PATENT NO. : 6,023,050
DATED : February 8, 2000
INVENTOR(S) : Violi

It is certified that error appears in the above-identified patent and that said Letters Patent is hereby corrected as shown below:

ON THE TITLE PAGE:

[56] References Cited

The following references should be added:

FOREIGN PATENT DOCUMENTS

| | | |
|---|---|---|
| 29606655 U1 | 08/1996 | DE |
| 0640310 A1 | 03/1995 | EP |
| 0523489 A1 | 01/1993 | EP |
| 2747097 A1 | 05/1979 | DE |
| 0233535 | 02/1987 | EP |
| 0244538 | 11/1986 | EP |
| 4131748 A1 | 03/1993 | DE |

Signed and Sealed this

Twenty-eighth Day of November, 2000

*Attest:*

*Attesting Officer*

Q. TODD DICKINSON

*Director of Patents and Trademarks*